US012123151B2

(12) United States Patent
Maier et al.

(10) Patent No.: US 12,123,151 B2
(45) Date of Patent: Oct. 22, 2024

(54) METHOD AND SYSTEM FOR MONITORING THE LOADING OF A TAMPING UNIT

(71) Applicant: Plasser & Theurer Export von Bahnbaumaschinen GmbH, Vienna (AT)

(72) Inventors: Bernhard Maier, Linz (AT); Alexander Puchmayr, Leonding (AT); Johannes Max-Theurer, Vienna (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 1028 days.

(21) Appl. No.: 16/768,133

(22) PCT Filed: Nov. 9, 2018

(86) PCT No.: PCT/EP2018/080719
§ 371 (c)(1),
(2) Date: May 29, 2020

(87) PCT Pub. No.: WO2019/110239
PCT Pub. Date: Jun. 13, 2019

(65) Prior Publication Data

US 2020/0370248 A1 Nov. 26, 2020

(30) Foreign Application Priority Data

Dec. 7, 2017 (AT) ..... A 472/2017

(51) Int. Cl.
*E01B 35/00* (2006.01)
*E01B 27/20* (2006.01)

(52) U.S. Cl.
CPC ..... *E01B 35/00* (2013.01); *E01B 27/20* (2013.01); *E01B 2203/012* (2013.01);
(Continued)

(58) Field of Classification Search
None
See application file for complete search history.

(56) References Cited

U.S. PATENT DOCUMENTS 4,744,303 A * 5/1988 Pasquini ..... E01B 27/16 104/12
5,566,619 A * 10/1996 Theurer ..... E01B 27/105 104/2

(Continued)

FOREIGN PATENT DOCUMENTS

AT 515801 A4 12/2015
CN 105189868 A 12/2015

(Continued)

OTHER PUBLICATIONS

Chinese Office Action in Chinese Application No. 201880077758.1 dated Jul. 2, 2021.

(Continued)

*Primary Examiner* — Adam D Tissot
(74) *Attorney, Agent, or Firm* — Collard & Roe, P.C.

(57) ABSTRACT

The invention relates to a method for load monitoring of a tamping unit of a track maintenance machine, wherein at least one sensor is arranged for recording a load on the tamping unit. In this, measuring data recorded by means of the sensor are stored over a time period (T) in an evaluation device, wherein at least one load-time progression for cyclical penetration operations of the tamping unit into a ballast bed is derived from the stored measuring data. With this, conclusions can be drawn as to the load stress situation of the tamping unit and the condition of the ballast bed.

14 Claims, 3 Drawing Sheets

(52) U.S. Cl.
CPC ..... *E01B 2203/04* (2013.01); *E01B 2203/12* (2013.01); *E01B 2203/16* (2013.01)

(56) References Cited

U.S. PATENT DOCUMENTS

| | | | | |
|---|---|---|---|---|
| 2016/0010287 | A1 * | 1/2016 | Lichtberger | E01B 27/16 104/10 |
| 2019/0055698 | A1 | 2/2019 | Hofstaetter et al. | |

FOREIGN PATENT DOCUMENTS

| | | | | | |
|---|---|---|---|---|---|
| CN | 205557207 | U | | 9/2016 | |
| EP | 1 857 982 | A2 | | 11/2007 | |
| EP | 2 154 497 | A2 | | 2/2010 | |
| GB | 1337513 | A | | 11/1973 | |
| GB | 2451310 | A | * | 1/2009 | E01B 27/16 |
| JP | S51149605 | A | | 12/1976 | |
| WO | WO-2014102401 | A1 | * | 7/2014 | G05B 23/0235 |
| WO | 2017/129215 | A1 | | 8/2017 | |

OTHER PUBLICATIONS

International Search Report of PCT/EP2018/080719, mailed Feb. 1, 2019 with English translation.
Chinese Office Action in Chinese Application No. 201880077758.1 dated Jul. 2, 2021 with English translation.
Austrian Search Report in Austrian Application No. A 472/2017 dated Jun. 21, 2018.
International Search Report in PCT/EP2018/080719 dated Feb. 1, 2019 in English.

* cited by examiner

METHOD AND SYSTEM FOR MONITORING THE LOADING OF A TAMPING UNIT

CROSS REFERENCE TO RELATED APPLICATIONS

This application is the National Stage of PCT/EP2018/080719 filed on Nov. 9, 2018, which claims priority under 35 U.S.C. § 119 of Austrian Application No. A 472/2017 filed on Dec. 7, 2017, the disclosures of which are incorporated by reference. The international application under PCT article 21(2) was not published in English.

FIELD OF TECHNOLOGY

The invention relates method for load monitoring of a tamping unit of a track maintenance machine, wherein at least one sensor is arranged for recording a load on the tamping unit. The invention further relates to a system for implementation of the method.

PRIOR ART

According to EP 2 154 497 A2, a device for bearing diagnosis at an eccentric shaft of a tamping unit by means of a vibration sensor is known. In this, the vibration sensor is arranged on a housing of an eccentric drive. Detected are only free vibrations of the eccentric drive in a phase during which the tamping unit is outside of a ballast bed. On the basis of changes of the data recorded at time intervals, conclusions are drawn as to the wear condition of the bearings of the eccentric shaft.

SUMMARY OF THE INVENTION

It is the object of the invention to provide an improvement over the prior art for a method and a system of the type mentioned at the beginning.

According to the invention, these objects are achieved by way of a method according to claim 1 and a system according to claim 12. Advantageous further developments of the invention become apparent from the dependent claims.

In this, measuring data recorded by means of the sensor are stored over a time period in an evaluation device, wherein at least one load-time progression for cyclical penetration operations of the tamping unit into a ballast bed is derived from the stored measuring data. In this manner, exterior or interior forces acting on the tamping unit or on tamping unit parts are taken into account in the chronological progression of a load value. On the one hand, this results in conclusions as to the loading stress situation of the tamping unit in order to prescribe maintenance measures or maintenance intervals. On the other hand, evaluations of a ballast bed treated by means of the tamping unit are possible, since conclusion as to the forces acting by the ballast bed on the tamping unit can be drawn from the progression of the recorded load value.

An embodiment of the invention provides that a load spectrum is calculated from the load-time progression. The load spectrum indicates immediately what loads the tamping unit has been subjected to over the recorded time span. A comparison to fatigue strength specifications yields a predictable life span of the tamping unit or of tamping unit parts.

For a current evaluation of the load situation by an operator, it is favourable if a load condition derived from the load-time progression is displayed by means of an output device. In this way, it is possible to react immediately to any exceeding of prescribed loading stress limits.

In an advantageous method, a hydraulic cylinder arranged in a lifting- and lowering device of the tamping unit is monitored, wherein a piston travel and hydraulic pressures acting in the hydraulic cylinder are recorded as measuring data. Based on these measuring data, a computation of a penetration force takes place by means of the evaluation device for each penetration operation. The corresponding load-time progression forms an evaluation basis for the tamping unit loading stress or the ballast bed quality.

A further development of the method provides that a penetration energy produced during penetration of the tamping unit into the ballast bed is calculated. A progression of the penetration energy over several tamping cycles is depicted as a corresponding load-time progression. In this, it can be useful to form an average value in order to attenuate possibly occurring anomalies during the recording of measuring data. The penetration energy to be mustered for penetrating into the ballast bed is a significant evaluation parameter for the ballast bed quality.

It is further advantageous if a penetration perform ance effective during penetration of the tamping unit into the ballast bed is calculated. It is possible to draw conclusions about the quality of a treated track from the progression of the penetration performance over a continuous working time period. In addition, the penetration performance to be mustered is a significant evaluation parameter for the tamping unit loading stress.

In an alternative embodiment of the invention or as an extension of the afore-mentioned method, it is provided that an eccentric drive of the tamping unit is monitored in that a performance of the eccentric drive is recorded over the working time period. By way of the progression of the generated eccenter performance as a load-time progression, a conclusion is drawn as to the loading stress situation of the tamping unit or the ballast bed quality.

It is advantageous in this if, in a hydraulic eccentric drive of the tamping unit, a pressure or a pressure difference and a flow volume are recorded as measuring data, and if from this a hydraulic performance of the eccentric drive is derived. Alternatively, the performance of the eccentric drive can be derived from a measured torque and a rotation speed.

The same applies to an embodiment with an electric eccentric drive of the tamping unit. This is advantageously monitored in that an applied voltage and a current are recorded as measuring data, wherein from this an electric performance of the eccentric drive is derived.

For automatized maintenance planning, it is advantageous if a maintenance- or inspection interval for the tamping unit is prescribed by means of a computer unit on the basis of the load-time progression.

In addition, it is advantageous for an automatized assessment of the ballast bed condition if a classification of the tamped ballast bed is carried out by means of a computer unit on the basis of the load-time progression.

An improvement of the method provides that the classification of the ballast bed, linked to an implementation time and/or an implementation location, is displayed in an output device. In this manner, it is immediately apparent which ballast bed quality existed in a particular work section.

In the system, according to the invention, for implementation of one of the afore-mentioned methods, the tamping unit comprises at least one sensor for recording a load, wherein the sensor is connected to the evaluation device, and wherein the evaluation device is designed for determining the load-time progression from the stored measuring data. In this, the evaluation device is located either on the tamping machine or in a system central arranged remotely. The measuring data are transmitted to the evaluation device either via signal lines or via an internal vehicle bus system or a wire-less communication device.

In an advantageous embodiment of the system, the evaluation device comprises a data acquisition device, a microprocessor and a communication means for the transmission of data to remote computer systems or output devices. The data acquisition device (Data Acquisition, DAQ) digitalizes analog sensor signals in order to determine the load-time progression from the digitalized measuring data by means of the microprocessor. In particular, characteristic signal areas are identified by means of the microprocessor, and relevant parameters are calculated.

A further development of the system provides that a machine control is connected to drives or control components of the tamping unit, and that the measuring data are supplied to the machine control in order to adjust controlling data. With this, an efficient control loop is realized in order to avoid any overloading of the tamping unit. Usefully in this, the machine control is also connected to the evaluation device in order to specify key figures, calculated by means of the evaluation device, as control parameters for the machine control. In this manner, for example, it is possible to automatically react to a change of the ballast bed quality.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
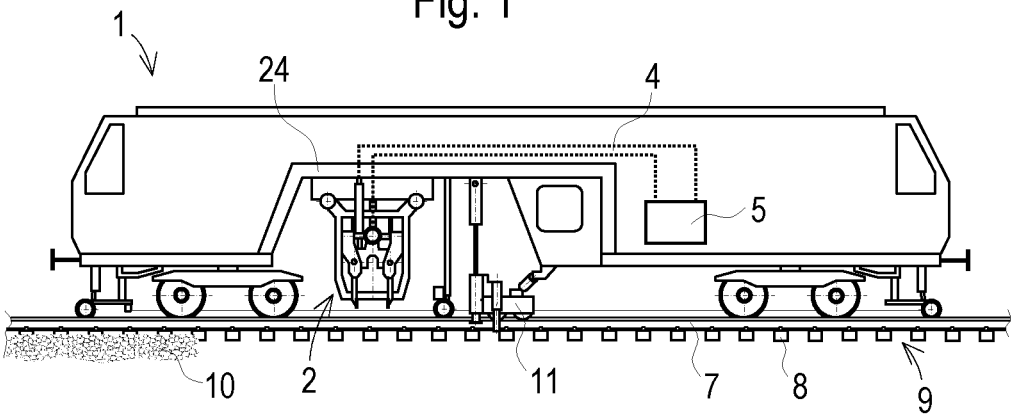
FIG. 1 tamping machine with tamping unit
FIG. 2 tamping unit
FIG. 3 signal progressions during two tamping cycles
FIG. 4 system structure
FIG. 5 performance progressions over time
FIG. 6 display in an output device

The system shown by way of example comprises a tamping machine 1 having a tamping unit 2 on which several sensors 3 are arranged for recording loads on the tamping unit 2. Sensor signals are transmitted via signal lines 4 to an evaluation device 5. In the evaluation device 5, measuring data recorded by means of the sensors 3 are stored over a time period T and evaluated. The tamping machine 1 is mobile on a track 6. The track 6 comprises a rail grid 9 composed of rails 7, sleepers 8 and rail fastening means, which is supported on a ballast bed 10 (FIG. 1).

Figure 2:
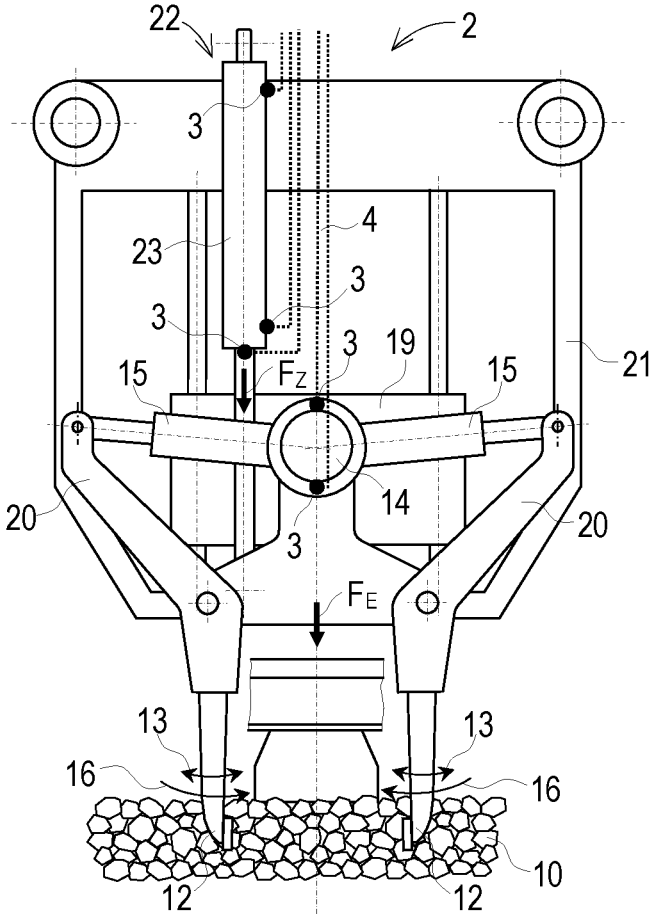

During tamping of the track 6, the rail grid 10 is brought into a desired position by means of lifting-lining unit 11. For stabilizing said position, tamping tools 12 of the tamping unit 2 penetrate into the ballast bed 10 between the sleepers 8. During this, the tamping tools 12 are actuated with a vibration motion 13. This vibration motion 13 is generated by means of an eccentric drive 14. Connected to the latter are squeezing cylinders 15 to squeeze the tamping tools 12 together in the lowered position, i.e. to move them towards one another (FIG. 2). The vibration motion 13 continues to superimpose this squeezing motion 16, wherein the vibration frequency during a penetration operation 17 (for example, 45 Hz) is usually chosen to be higher than during a squeezing operation 18 (for example, 35 Hz). In this manner, penetration into the ballast is facilitated because, with an increased frequency, the ballast set in vibration resembles a flowing medium.

The eccentric drive 14 is arranged on a tool carrier 19. In addition, pivot arms 20 are mounted on the tool carrier 19. These are equipped at lower ends with the tamping tools 12. At upper ends, the pivot arms 20 are coupled via the squeezing cylinders 15 to an eccentric shaft powered by means of the eccentric drive 14. The tool carrier 19 is guided in an assembly frame 21 and vertically movable by means of a lifting- and lowering device 22. In this, the lifting- and lowering device 22 includes a hydraulic cylinder 23. The hydraulic cylinder 23 is braced against a machine frame 24 of the tamping machine 1 and, in operation, generates a lifting- and lowering force Fz on the tool carrier 19. In this, the lowering force Fz applied by the hydraulic cylinder 23 during a penetration operation 17 is part of a penetration force $F_E$ which acts on the ballast bed 10.

By measuring the hydraulic pressures acting in the hydraulic cylinder 23, it is possible in a simple manner to determine the lowering force Fz. For determining the penetration force $F_E$, the mass and the acceleration of the tool carrier 19 including the parts arranged thereon are additionally taken into account. In this, the acceleration can be calculated by double differentiation from a measured piston travel x of the hydraulic cylinder 23. Thus, with known mass of the moved parts, merely a pressure- and travel measurement is carried out on the hydraulic cylinder 23 for determining the penetration force $F_E$.

The recording of the measuring data over a time period T results in a progression of the penetration force $F_E$ over the time t. In this manner, one receives at first a simple load-time progression. For further evaluations, more particularly several tamping cycles are monitored, and the greatest penetration force in each case during the respective penetration operation 17 is stored, so that the load-time progression indicates the maximum penetration force over the time t, i.e. over a multitude of successive tamping cycles. From the load-time progression or a load-time function, it is possible in a simple way to determine a load spectrum. With this it is immediately apparent which load stresses have occurred over the regarded time span T.

For further development of the load-time progression, the penetration energy $E_E$ is calculated for each penetration operation 17:

$$E_E=\int_{x_0}^{x_1}F_E(x)dx \text{ or} \tag{1}$$

$$E_E=\int_{t_0}^{t_1}F_E(x(t))\dot{x}(t)dt \text{ with} \tag{2}$$

$x_0$ . . . start of a penetration path
$x_1$ . . . end of a penetration path
$t_0$ . . . begin of a penetration operation 17
$t_1$ . . . end of a penetration operation 17

By monitoring several penetration operations 17 over the time period T, this yields the progression of the penetration energy $E_E$ over the time t. In this, a formation of an average value over several penetration operations 17 leads to an attenuation of possibly occurring anomalies during the recording of measuring data.

In further sequence, it can be useful to determine the penetration performance $P_E$ generated during the respective penetration operations:

$$P_E = \frac{E_E}{t} \tag{3}$$

From a progression of the penetration performance $P_E$ over a continuous working time period Track, it is possible to draw conclusions as to both the loading stress situation of the tamping unit 2 as well as the quality of the ballast bed 10 treated during the working time period T. Here also, the formation of an average value is useful.

In the case of multiple tamping, several tamping operations (subcycles) take place at one position of the track 6 in order to achieve a prescribed degree of compaction of the ballast bed 10. In this case, several stress-time progressions are formed, i.e. corresponding to the sequence of the subcycles. In case of double tamping, for example, the progression of the penetration force $F_E$, the penetration energy $E_E$ or the penetration performance $P_E$ is determined for all first subcycles and separately for all second subcycles.

A hydraulic motor is provided, for example, as eccentric drive 14 for vibration generation. In this, a pressure difference Δp between inflow and outflow of the hydraulic oil and a flow volume Q of the hydraulic oil is measured in order to determine a hydraulic performance $P_H$ of the eccentric drive 14:

$$P_H = \Delta p \cdot Q \tag{4}$$

The eccenter performance $P_H$ is averaged over the respective tamping cycle. For a continuous working time span T with numerous tamping cycles, this results in the progression of the eccenter performance $P_H$ over the time track as a vibration stress-time progression.

Figure 3:
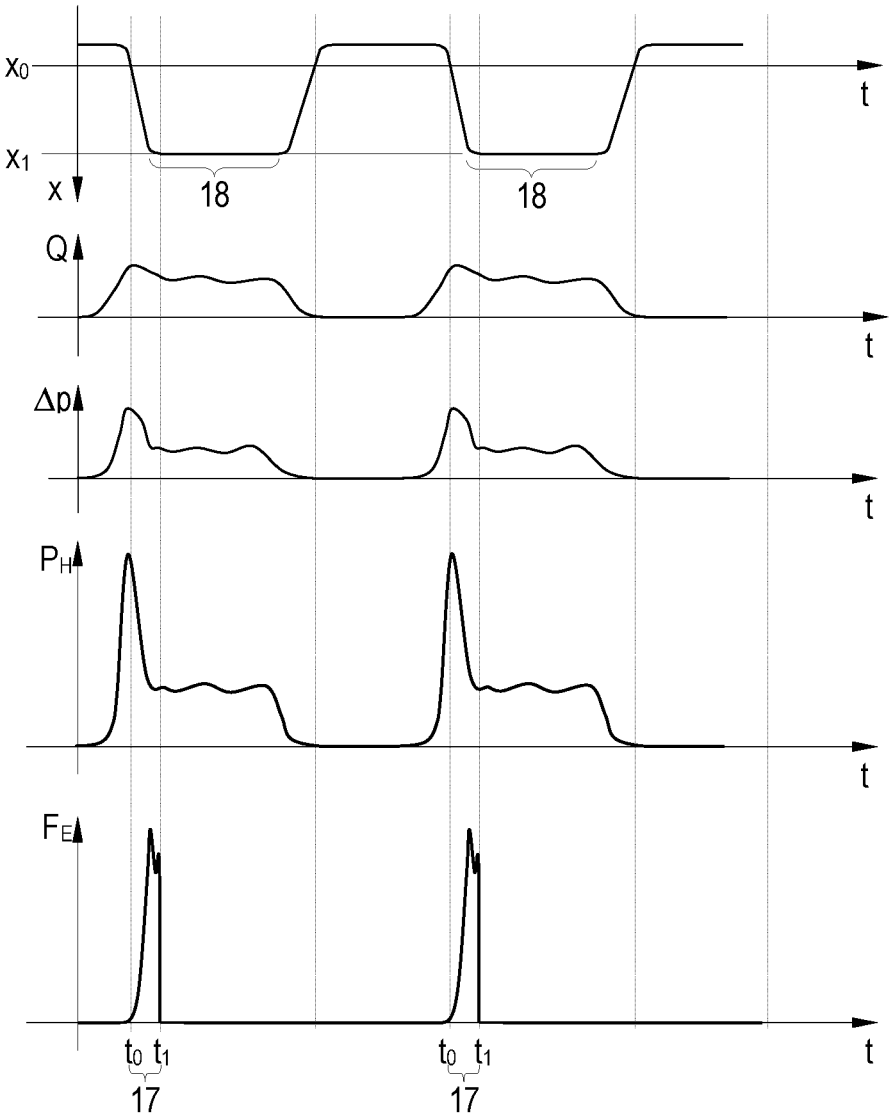

The individual progressions are shown in a simplified manner in FIG. 3. The uppermost diagram shows a progression of the penetration path x (penetration depth) over the time t. This corresponds to the recorded piston travel x of the hydraulic cylinder 23. At the beginning of the penetration path $x_0$, the tips of the tamping tools 12 touch the surface of the ballast bed 10 and, at the end of the penetration path $x_1$, the tamping tools 12 have reached the intended maximum penetration depth. In the diagrams below, the progressions of the flow volume Q, the pressure difference Δp, the resulting eccenter performance $P_H$ and, all the way at the bottom, the progression of the penetration force $F_E$ are shown with a corresponding time axis.

Figure 4:
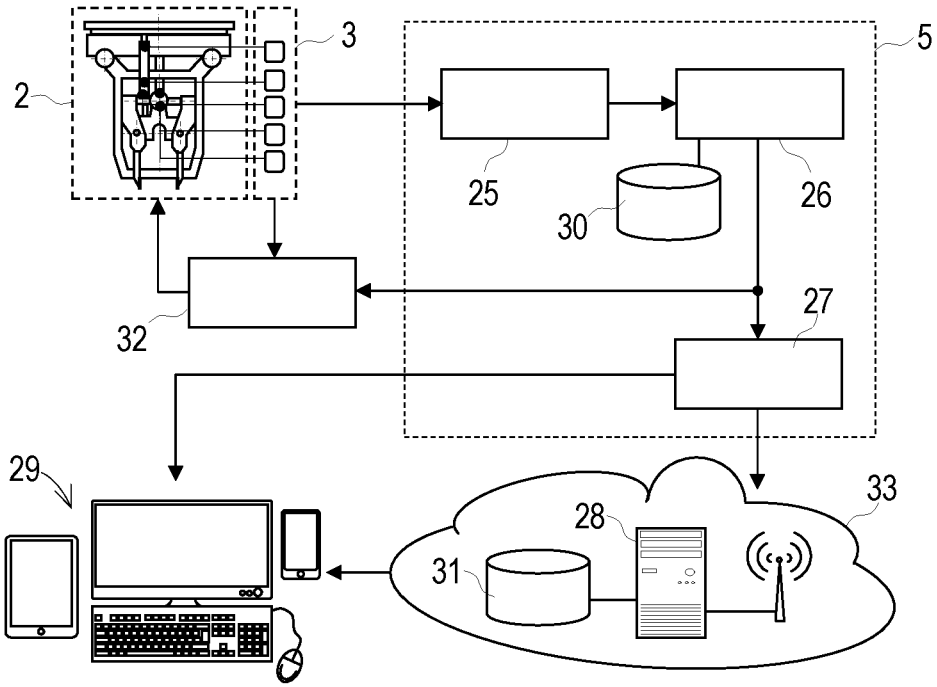

As visible in FIG. 4, the evaluation device 5 comprises a data acquisition device 25, a microprocessor 26 and a communication means 27 (a modem, for example) for transmission of data to remote computer systems 28 or output devices 29. For intermediate storage of data, the microprocessor 26 is conveniently connected to a storage device 30. The remote computer system 28 additionally comprises a database device 31 for storing historic data.

Output signals of the sensors 3 are supplied to a machine control 32 for forming a regulatory cycle. In this manner, an efficient adjustment of control signals to changing system conditions takes place. As a result of digitalizing by means of the data acquisition device 25, digital measuring data are formed from the output signals of the sensors 3 and supplied to the microprocessor 26. In this, storage of the measuring data takes place over the prescribed time span T. By means of the microprocessor 26, a load-time progression is compiled from the measuring data and evaluated. During this, characteristic signal areas are identified and relevant characteristic values are calculated, for example, load spectrums of the lifting- and lowering device 22 and of the eccentric drive 14, or classifications of the ballast bed 10. For possible adjustment of control parameters, the characteristic values are transmitted to the machine control 32. In this manner, for example, an adaptation of the tamping parameters to a determined hardness of the ballast bed 10 takes place.

Advantageously, the remote computer system 28 is arranged in a system central 33 in order to analyze currently recorded data as well as historic data and to prescribe maintenance- or inspection intervals, derived therefrom, for the tamping unit 2. As a criterion for this, for example, a comparison of a formed load spectrum to prescribed fatigue strength areas can be used.

Figure 5:
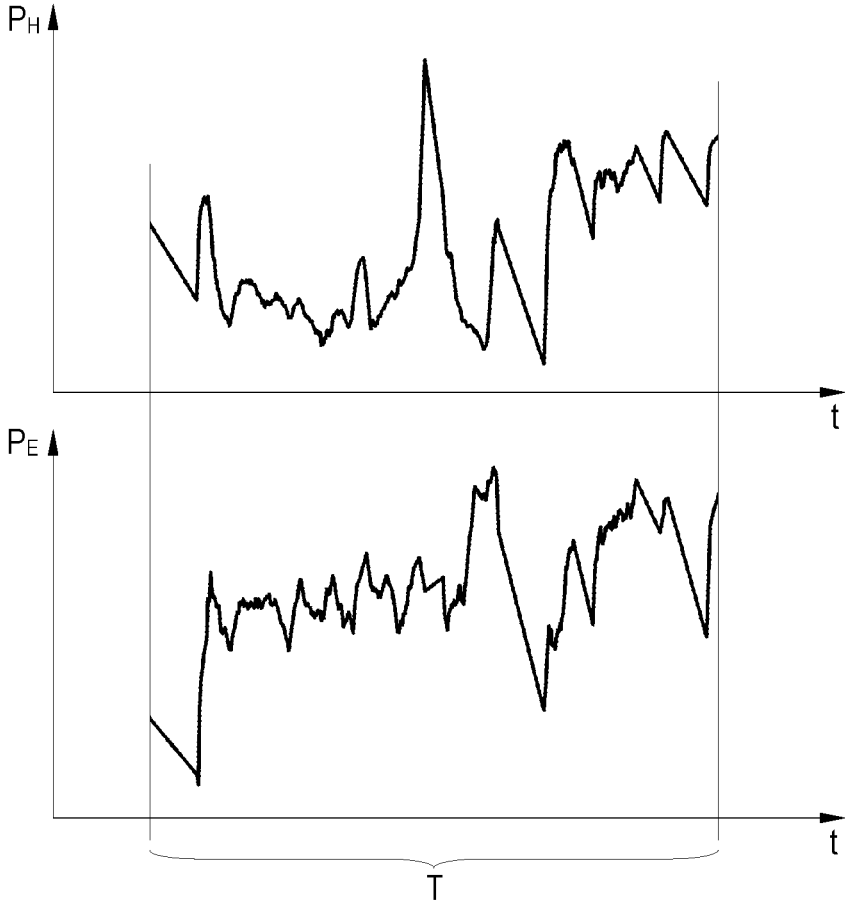

Examples of progressions of the eccenter performance $P_H$ and the penetration performance $P_E$ over a continuous working time span T are shown in FIG. 5. In this, a similarity between the two progressions is apparent since the quality of the ballast bed 10 has an effect on both values $P_H$, $P_E$. A harder ballast bed 10 with already advanced service life requires both a higher eccenter performance $P_H$ as well as a higher penetration performance $P_E$. In the case of a new track with new ballast, however, the performances $P_H$, $P_E$ to be provided are lower.

In order to assign a prescribed quality class (soft new layer, medium, hard-old) to a respective treatment section of a ballast bed 10, corresponding value scopes are prescribed for at least one of the two performance values $P_H$, $P_E$. By comparison of the determined performance progressions to these pre-set value scopes, an automatized classification of the treated ballast bed sections takes place.

Advantageously, the determined quality class, linked to an implementation time and an implementation location, is shown in an output device 29 (computer display, tablet, etc.). In the simplest case, this takes place in tabular form with date, construction site designation, quality class as well as average eccenter performance $P_H$ and average penetration performance $P_E$.

Figure 6:
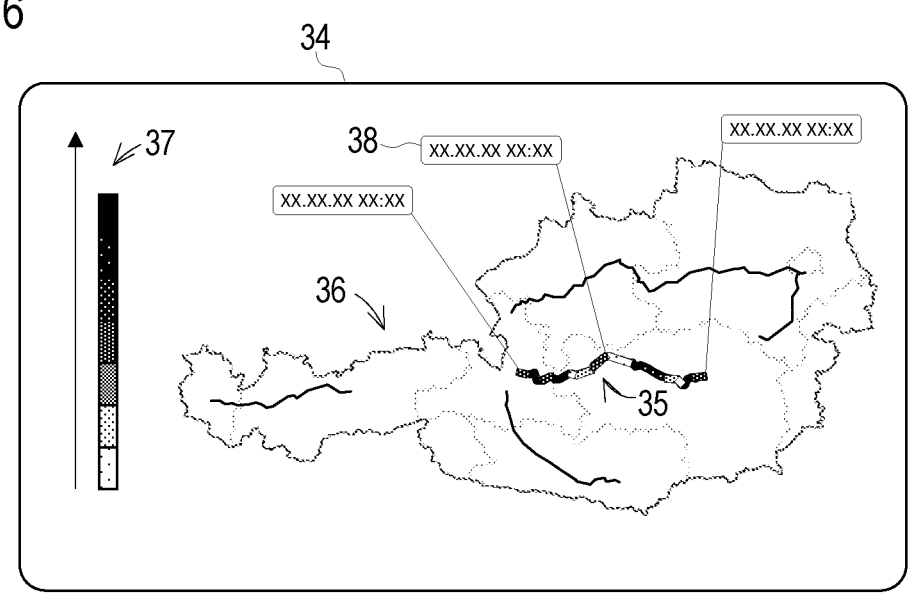

A display 34 with high information content is shown in FIG. 6. In this, a construction site 35 is drawn in an electronic map 36, wherein differently marked quality classes are assigned to individual construction site sections. The basis for this is a prescribed hardness scale 37 for the ballast bed 10. In addition, date- and time indications 38 are shown at distinctive points of the construction site.

The invention claimed is:

1. A method for load monitoring of a tamping unit of a track maintenance machine, comprising the steps of:

recording using sensors a piston travel (x) and a hydraulic pressure acting in a monitored hydraulic cylinder arranged in a lifting and lowering device of the tamping unit as measuring data for deriving a load on the tamping unit wherein recording the measuring data by means of the sensors, wherein the measuring data are stored over a time period (T) in an evaluation device, and deriving at least one load-time progression for cyclical penetration operations of the tamping unit into a ballast bed by means of the hydraulic cylinder from the stored measuring data.

2. The method according to claim 1, further comprising the step of calculating a load spectrum from the load-time progression.

3. The method according to claim 1, further comprising the step of calculating a penetration energy ($E_E$) produced during penetration of the tamping unit into the ballast bed.

4. The method according to claim 1, further comprising the step of calculating a penetration performance ($P_E$) effective during penetration of the tamping unit into the ballast bed is calculated.

5. The method according to claim 1, further comprising the step of monitoring an eccentric drive of the tamping unit, and recording a performance of the eccentric drive over the time period (T).

6. The method according to claim 4, further comprising the step of monitoring a-hydraulic eccentric drive of the tamping unit, and recording a pressure (□p) and a flow volume (Q) as measuring data, and deriving from this a hydraulic performance ($P_H$) of the eccentric drive.

7. The method according to claim 4, further comprising the steps of monitoring an electric eccentric drive of the tamping unit, and recording a voltage and a current as measuring data, and deriving from this an electric performance of the eccentric drive.

8. The method according to claim 1, further comprising the step of proscribing a maintenance or inspection interval for the tamping unit by means of a computer unit on the basis of the load-time progression.

9. The method according to claim 1, wherein a classification of the tamped ballast bed is carried out by means of a computer unit on the basis of the load-time progression.

10. The method according to claim 9, further comprising the step of displaying the classification of the ballast bed, linked to an implementation time and/or an implementation location, in an output device.

11. A system for implementation of a method according to claim 1, wherein the tamping unit comprises sensors for recording a piston travel and a hydraulic pressure of a monitored hydraulic cylinder arranged in the lifting and lowering device of the temping unit for deriving a load, wherein the sensors are connected to the evaluation device and wherein the evaluation device is designed for determining the load-time progression from the stored measuring data.

12. The system according to claim 11, wherein the evaluation device comprises a data acquisition device, a microprocessor and a communication modem for the transmission of data to remote computer systems or output devices.

13. The system according to claim 11, wherein a machine control is connected to drives or control components of the tamping unit, and wherein the measuring data are supplied to the machine control in order to adjust controlling data.

14. The system according to claim 13, wherein the machine control is connected to the evaluation device to specify characteristic values, calculated by means of the evaluation device, as control parameters.

* * * * *